US006389715B1

(12) United States Patent
Krajcir

(10) Patent No.: US 6,389,715 B1
(45) **Date of Patent: *May 21, 2002**

(54) TOE BOX AND METATARSAL PROTECTORS FOR SAFETY FOOTWEAR

(76) Inventor: Dezi A. Krajcir, 330 Ramsay Drive, Dunnville, Ont (CA), N1A 2X1

( * ) Notice: Subject to any disclaimer, the term of this patent is extended or adjusted under 35 U.S.C. 154(b) by 0 days.

This patent is subject to a terminal disclaimer.

(21) Appl. No.: 09/506,292

(22) Filed: Feb. 18, 2000

Related U.S. Application Data

(63) Continuation-in-part of application No. 09/200,427, filed on Nov. 27, 1998, now abandoned, which is a continuation-in-part of application No. 08/933,883, filed on Sep. 19, 1997, now Pat. No. 5,878,511.

(51) Int. Cl.[7] ..... A43C 13/14
(52) U.S. Cl. ..... 36/77 R; 36/72 R
(58) Field of Search ..... 36/77 R, 72 R, 36/96

(56) References Cited

FOREIGN PATENT DOCUMENTS

| | | |
|---|---|---|
| DE | 2027661 | 12/1971 |
| DE | 7243016 | 3/1973 |
| DE | 2536443 | 2/1977 |
| EP | 0030839 | 6/1981 |
| NL | 7612407 | 5/1978 |

*Primary Examiner*—Ted Kavanaugh
(74) *Attorney, Agent, or Firm*—Stanley J. Rogers

(57) ABSTRACT

A toe box protector, or a metatarsal protector, or a combined protector for safety footwear are molded from plastics material either integrally or as separate parts. Each protector part comprises a body of generally U-shaped cross section provided at the central part of its top outer surface with a force receiving part that overlies the central part with its lower surface spaced from the central part and of concave shape toward the central part, thereby forming an arcuate air space at this location. In an integrally molded structure each force receiving part has two transversely spaced integral junctions with the respective body; alternatively they are molded separately and the force receiving part has longitudinal edges that engage two mutually facing, spaced surfaces on the body part. Compression and impact forces applied to the force receiving part act to flatten it and to press it toward the central part, reducing the height of the interposed arcuate air space, with conversion of such forces to corresponding longitudinal forces distributed along the integral junctions or the butting surfaces and to compression forces in the sides of the U. The separate force receiving plate member may comprise a sheet of plastics material or metal. Each protector body part and force receiving plate member may be divided along its length by transversely extending slots to increase its longitudinal flexibility so as to accommodate the action of walking.

25 Claims, 4 Drawing Sheets

10B
10
10A
36
38
18
16
14
19
12B
20
12A
12

34
24A
24
14A
32
14B
28
26A
26
30
18A
3
26B
16B
28
30
32
3
18B
35
19
23
14
16A
16
22
18
78
35
35

10B
10A
26
26A
24
24B
24A
21
34
32
18
10
39
32
39
26B
14A
14
14B
20
76
35
35
22
12
12A
12B
76
16
76

66
58
60
64
62
66
70
60
56
5
64
44
70
50
54
52
7
54
16
68
30
6
46
68
40
7
52
42
48
28
6
14
35
35
5
35

Fig 5
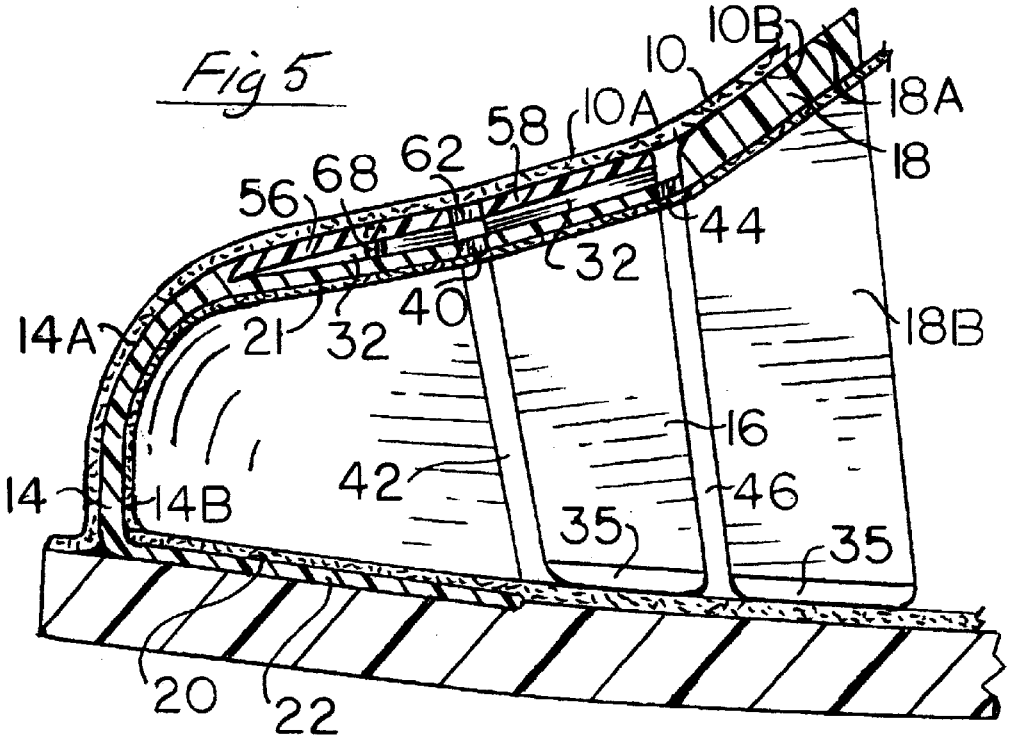
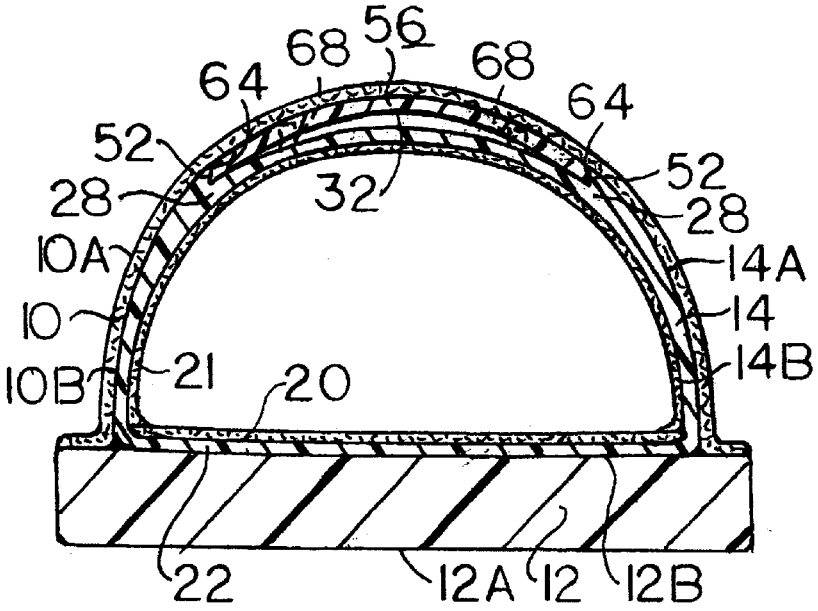
Fig 6

TOE BOX AND METATARSAL PROTECTORS FOR SAFETY FOOTWEAR

CROSS-REFERENCE TO RELATED APPLICATIONS

This application is a continuation-in-part of my prior application Ser. No. 09/200,427, filed Nov. 27 1998 now abandoned, which is a continuation-in-part of my prior application Ser. No. 08/933,883, filed Sep. 19 1997, now Pat. No. 5,878,511, issued Mar. 9 1999.

FIELD OF THE INVENTION

This invention is concerned with improvements in or relating to toe box and/or metatarsal protectors as used in safety footwear, namely boots and shoes that are worn in locations where there is danger of impact or compression forces being applied to and injuring the feet of the wearers.

BACKGROUND OF THE INVENTION

Many industries now require that at all times workers wear safety footwear to protect their feet against injury caused, for example, by blows from falling objects, or crushing such as may be caused by a vehicle wheel rolling over the foot. Almost all safety footwear currently available comprise a toe protector, usually of steel, alternatively called a box toe or a toe box, providing a protective arch above the toes through which any compression or impact force applied to its top surface is transmitted to the insole on which it rests, and through the insole to the outsole and the ground. It is a requirement for official certification (more details of which are given below) that the toe box is incorporated into the footwear during its manufacture so as to be an integral part thereof. Also, provision is now commonly made to protect the metatarsus, namely the five long bones of the instep extending from the toes to the remainder of the bones of the foot. Many of the prior proposals for metatarsal protection comprise a guard that is applied to the exterior of the boot, but increasingly the protector is incorporated into the footwear as an integral part, it also being arranged so that forces applied to it are transmitted through the insole and outsole to the ground.

The Occupational Health & Safety Association (OHSA) specifies test and performance standards that have been established by American National Standards Inc. (ANSI) which safety footwear must pass if they are to be certified by them. The current standards are identified as ANSI 241/1999. The Canadian Standards Association (CSA) have adopted equivalent standards. In commercial practice these standards are sufficiently important that a safety boot is virtually unsalable unless it is entitled to and carries at least the minimum standard designation, i.e. I30 for toe impact force. Preferably, it is also certified as to its resistance to compression, the minimum designation being C30 for toe compression force, although for many jurisdictions and industries such certification is not a requirement. If a metatarsal protector is included then preferably it will at least meet the minimum standard of Mt30 for metatarsal impact force. The maximum standards available using the ANSI system are designated C75 and I75, with or without Mt75; there are also intermediate standards C50 and I50, with or without Mt50. The tests required and the standards indicated by these designations are explained below.

In the compression force test procedure for the toe box protector (there is no equivalent test procedure for a metatarsal protector) it is subjected to a crushing force using any standard compression testing apparatus that is applied at a rate of approximately 22.7 Kg per second (50 lbs; 222.4 Newtons) after an initial load of 227 Kg (500 lbs; 2224 Newtons) has first been applied. The vamp and upper of the test boot is cut away to allow insertion of a cylindrical steel test gauge into the toe box interior, the gauge being slid back and forth on the insole as the pressure is increased. The diameter of the gauge is 12.7 mm (16/32 in) for men's footwear and 11.9 mm (15/32 in) for women's footwear, and the compression resistance of the specimen is the compressive load that reduces the internal clearance in the toe box until movement of the gauge either forward or backward is first prevented. The three certifications available are designated C/30 or C/50 or C/75 and indicate respectively that the footwear will withstand a compression force of 455 Kg (1,000 lbs; 4,448 Newtons), or 795 Kg (1,750 lbs; 7,784 Newtons), or 1,134 Kg (2,500 lbs; 11,121 Newtons).

The test procedure for toe box impact force resistance involves dropping a standard weight of 22.7 Kg (50 pounds) with a cylindrical impact nose of 51mm (2 ins) length and 25.4 mm (1 in) diameter on to the toe portion of a specimen boot (size 9D for men's footwear and 8B for women's footwear) selected at random from stock after at least 14 days have elapsed from the time of completion of its manufacture. The impact occurs at a point at the approximate centre of the toe box and 13 mm (0.5 in)in front of its back edge, the weight being dropped from a height such that it exerts an impact force of the selected one of the three values, namely 40.7 Joules (30 foot pounds), or 67.8 Joules (50 foot pounds), or 101.7 Joules (75 foot pounds). The maximum downward compression suffered by the toe box during the impact, and the corresponding minimum internal clearance available to the wearer's toes, is measured by a cylindrical lump of modelling clay or wax placed inside the box under the impact zone, the lump not exceeding 25.4 mm (1 in) in diameter and being shaped to extend between and make contact with the dome of the toe box and with the insole. After impact the cylinder is removed and its height measured at its lowest point to the nearest 0.794 mm (1/32 in). The required minimum internal clearance in the toe box interior during and after impact, as indicated by measurement of the compressed lump, is 12.7 mm (16/32 in) for men's footwear and 11.9 mm (15/32 in) for women's footwear. The footwear is certified according to the standard reached, and can be labelled with the designation I/30, I/50 or I/75 respectively.

The equivalent impact force test for a metatarsal protector employs similar equipment to that used to test the toe box, with the difference that the impactor at the bottom of the weight is a cylindrical bar extending transversely of the length of the boot. The test again requires an impact force of specified value, and this force is applied at a point 8.9 cm (3.5 in) from the outside tip of the 9D boot toe and 8.6 cm (3.375 in) for the 8B boot. A wax body of specified shape and composition is held in place within the boot beneath the impact zone, the required minimum internal clearance beneath the protector after the impact, as indicated by the height of the deformed body being 2.5 cm (32/32 in) for the male 9D boot and 2.4 cm (30/16 in) for the female 8B boot. The impact forces employed are again of nominal value 30 foot pounds (40.7 Joules), or 50 foot pounds (67.8 Joules), or 75 foot pounds (101.7 Joules), footwear that passes the respective test being certified with the designation Mt/30, Mt/50 or Mt/75 respectively.

Box toes of plastics materials are available, but they are significantly thicker than the commonly used steel box toe, so that it is more difficult to incorporate them into the boot construction without the resultant boot toe appearing much more bulky, especially in side elevation. Moreover, most safety footwear is manufactured by molding the outsole to the remainder of the boot and a box toe that is significantly thicker makes it impossible to use existing molds used with steel box toes, so that expensive new molds are required for each size of boot. Metatarsal protectors of plastics material, e.g. high density polyethylene or polypropylene (HDPE or HDPP), ABS and various proprietary nylons, are also available and again, if the above described impact standards are to be met the protector is such thickness that, even if the more expensive high modulus plastics materials are used, it is difficult to incorporate in safety footwear of standard sizes. The manufacture of both box toes and metatarsal protectors from plastics material has the advantage that even if of complex shape they can be molded in a single relatively inexpensive operation. There is also the possibility that protectors that are lighter in weight can also be produced. Manufacturers of safety footwear face an inherent marketing problem that whether the footwear is supplied by the employer at cost, or with a subsidy, or whether it is purchased directly by the wearer, it is basically a product for which a relatively low purchase price is required by the customer, so that minimization of manufacturing cost is of primary importance.

A problem which many combined toe and metatarsal protectors are intended to at least alleviate, and if possible overcome, is that structures which are strong enough to provide the necessary protection are also usually very stiff, to the extent that they make walking or kneeling difficult. German Laid-Open application (Offenlegungschrift) No. 2536443, published Feb. 17 1977, describes a combined toe and metatarsal protector for safety footwear which attempts to provide a solution to this problem. To this end the toe box and a metatarsal plate, which preferably are of steel but which can also be of molded plastics material or hardened light metal (sic), are separate from one another and the lower end of the metatarsal plate protrudes into a second cavity above the toe-receiving cavity provided by the toe box. This second cavity is of sufficient size to allow the required forward and backward flexing between the two parts, while restraining the metatarsal plate against unwanted displacement. There is no disclosure or teaching that the structure envisaged could be designed so as to improve the resistance of the resulting toe box to impact and compression forces.

SUMMARY OF THE INVENTION

It is therefore the principal object of the invention to provide a toe box protector, or a metatarsal protector, or a combination toe box and metatarsal protector, that can readily be molded from plastics material and meet at least the minimum test requirements for ANSI certification as described above, and preferably able to meet the maximum requirements.

It is another object to provide a toe box protector, or a metatarsal protector, or a combination toe box and metatarsal protector, molded from plastics material that is able meet the ANSI test requirements for certification as described above while being sufficiently lower in height in side profile that it can be incorporated by molding in safety footwear using molds previously employed for steel box toes.

In accordance with the present invention there is provided a toe box protector for safety footwear that comprise an upper and a sole joined to one another, the upper and sole each having respective outer and inner surfaces and having respective registering toe regions;

wherein the toe box protector comprises a body molded from plastics material to have a generally U-shaped transverse cross section, the body having a top portion constituting a base of the U and two side portions constituting respective sides of the U;

wherein the toe box protector when incorporated into safety footwear is interposed between the upper and sole toe regions, and when so interposed has an outer surface convex toward the inner surface of the upper and an inner surface concave toward the inner surface of the sole;

wherein the toe box protector also comprises a force receiving part having respective upper and lower surfaces and overlying the central part of the top portion outer surface with its lower surface spaced from the central part, the force receiving part being of concave shape toward the central part so as to provide an arcuate space of predetermined height between the force receiving part lower surface and the top portion central part outer surface and to have two transversely spaced junctions with the remainder of the body;

whereby compression and impact forces applied to the force receiving part urge the force receiving part toward the central part of the top portion with corresponding reduction in the height of the arcuate space and conversion of such compression and impact forces to corresponding longitudinal forces distributed along the transversely spaced junctions; and wherein the thicknesses of the two body side portions, of the body top portion, and of the force receiving part, together with the height of the arcuate space, are such that the protector maintains a minimum internal clearance in the foot receiving cavity of 12.7 mm ($^{16}/_{32}$ in) for men's footwear and 11.9 mm ($^{15}/_{32}$ in) for women's footwear when subjected to a compression force of at least 455 Kg (1,000 lbs; 4,448 Newtons) or to an impact force of at least 40.7 joules (30 foot pounds).

Also in accordance with the invention there is provided a metatarsal protector for safety footwear that comprise an upper and a sole joined to one another, the upper and sole each having respective outer and inner surfaces and having respective registering metatarsal regions;

wherein the metatarsal protector comprises a body molded from plastics material to have a generally U-shaped transverse cross section, the body having a top portion constituting a base of the U and two side portions constituting sides of the U, the protector thereby defining a foot receiving cavity whose height constitutes its internal clearance;

wherein the metatarsal protector when incorporated into safety footwear is interposed between the metatarsal regions, and when so interposed has an outer surface convex toward the inner surface of the upper and an inner surface concave toward the inner surface of the sole;

wherein the metatarsal protector also comprises a force receiving part having respective upper and lower surfaces and overlying the central part of the top portion outer surface with its lower surface spaced from the central part, the force receiving part being of concave shape toward the central part so as to provide an arcuate space of predetermined height shape between the force receiving part lower surface and the top portion central part outer surface and to have two transversely spaced junctions with the remainder of the body;

whereby compression and impact forces applied to the force receiving part urge the force receiving part toward the central part of the top portion with corresponding reduction in the height of the arcuate space and conversion of such compression and impact forces to corresponding longitudinal forces distributed along the transversely spaced junctions; and wherein the thicknesses of the two body side portions, of the top portion, and of the force receiving part, together with the height of the arcuate space, are such that the protector maintains a minimum internal clearance of 25.4 mm (32/32 in) for men's footwear and 24 mm (30/32 in) for women's footwear when subjected to an impact force of at least 40.7 joules (30 foot pounds).

Further in accordance with the invention there is provided a toe box and metatarsal protector that is a combination of the toe box and metatarsal protectors of the invention.

DESCRIPTION OF THE DRAWINGS

Toe box protectors, metatarsal protectors and combination toe box and metatarsal protectors that are particular preferred embodiments of the invention will now be described, by way of example, with reference to the accompanying diagrammatic drawings, wherein:

FIG. 5 is a cross-section similar to FIG. 3 taken on the line 5—5 in FIG. 4;

FIG. 6 is a transverse cross-section through the toe protector part of FIG. 4 taken on the line 6—6 of FIG. 4;

DESCRIPTION OF THE PRESENT EMBODIMENTS

Figure 1:
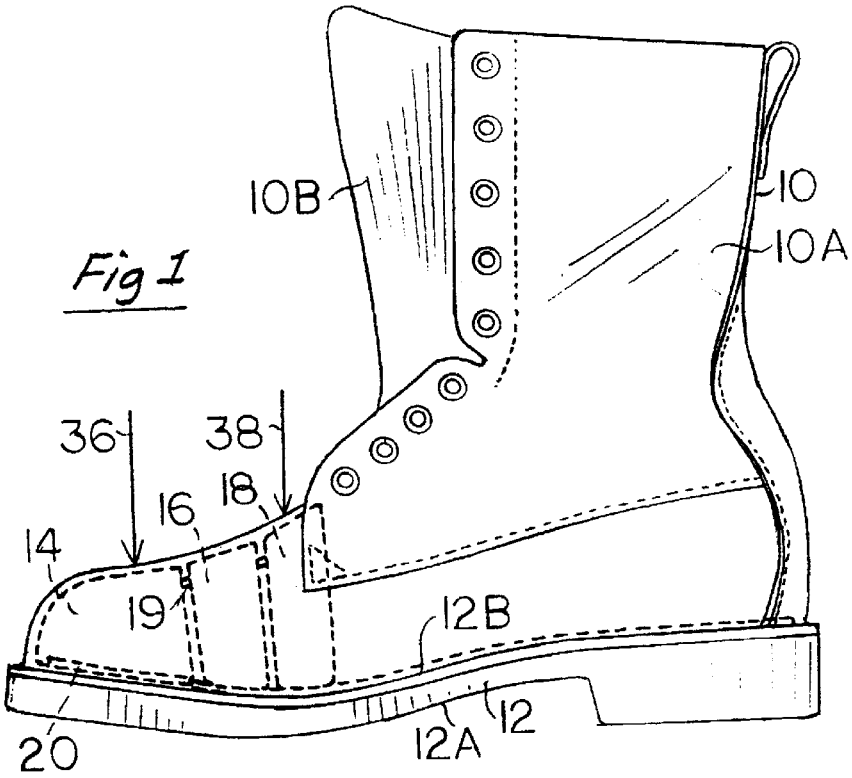
FIG. 1 is a side elevation of a safety boot having a combination toe and metatarsal protector that is a first embodiment of the invention incorporated therein, shown in broken lines, each protector being an integrally molded body.

Although for convenience the safety footwear shown in the drawings and described below is a safety boot, the invention is applicable equally to safety shoes, and both types of safety footwear are within the scope of the language of the claims. Footwear usually comprise an upper attached to a composite sole structure comprising as a minimum an insole and an outsole; other structural elements such as a midsole and, in the case of safety footwear a steel plate protecting against penetration by nails and similar sharp objects, may be interposed between the insole and outsole. For convenience in the language used in the claims any such composite sole structure is referred to simply as the footwear sole whatever its actual structure. For convenience the outer surface of an element is referenced using the same reference number as the element with the subscript A, while the corresponding inner surface reference employs the subscript B.

FIG. 1 shows in side elevation a safety boot comprising a typical boot upper 10 having respective outer and inner surfaces 10A and 10B, and an outsole 12 having respective outer and inner surfaces 12A and 12B, the upper and the outsole having respective toe regions registering with one another and respective registering metatarsal regions. A combination toe box and metatarsal protector of the invention made of molded plastics material is incorporated into the boot between the inner surface 10B of the boot upper and the inner surface 12B of the outsole. In this embodiment the combined protector comprises, in order from the toe, a toe box part 14 between the two toe regions, a forward metatarsal protector part 16 between the two corresponding forward metatarsal regions, and a rearward metatarsal protector part 18 between the corresponding rearward metatarsal regions, the two metatarsal protector parts being of approximately the same length. In this embodiment each of the three parts is molded separately and attached to one another for storage and installation by a thin strip connector 19 of flexible material, such as a strip of synthetic fabric, glued or cemented to the inner surfaces of the protector parts. An insole 20 lies against the inner surface 12B of the outsole and extends into the interior of the toe box part. An inner lining 21 of a soft material is fitted against the inner surfaces of the protector parts and the upper. The boot may comprise other functional parts, such as a midsole between the insole and outsole, and a metal or plastics material plate covering the instep to protect against penetration by spikes, but such other parts are not pertinent to the present invention and are not illustrated, the manner in which they may be incorporated into footwear being well known to those skilled in this particular art.

Figure 2:
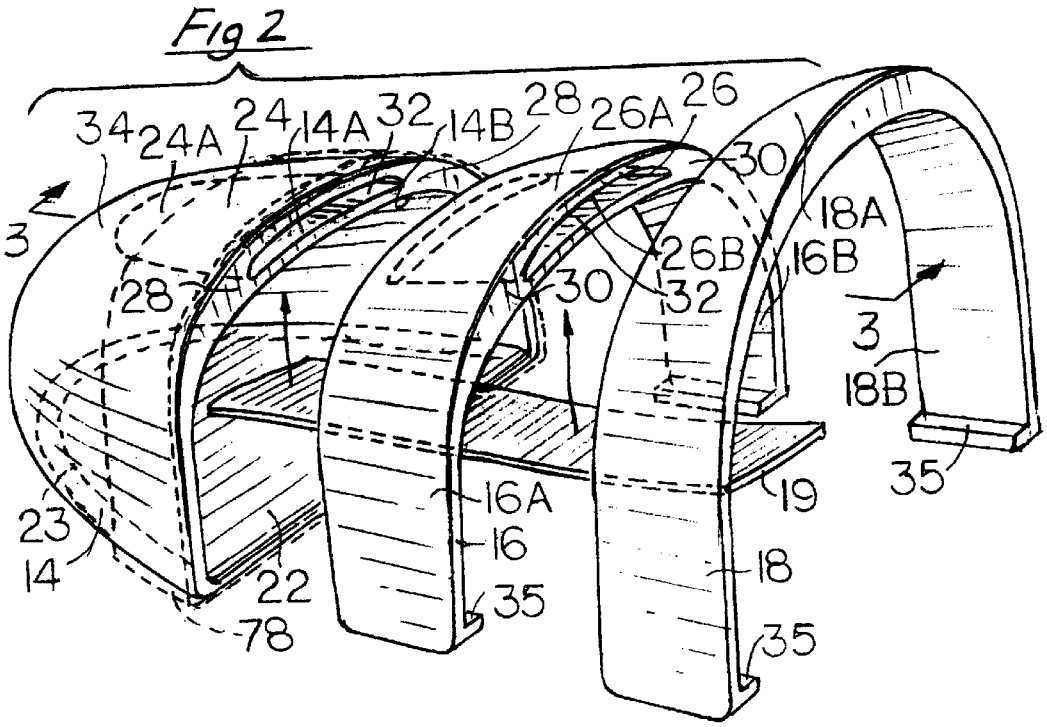
FIG. 2 is an exploded perspective view of the combination protector of FIG. 1, taken from above one side and to the rear.

The box toe protector part 14 comprises a body of generally U-shaped transverse cross section having a top portion constituting the base of the U and two approximately parallel side portions constituting the sides of the U, the part therefore having an outer surface 14A that is convex toward inner surface 10B of the boot upper and an inner surface 14B that is concave toward the inner surface 12B of the outsole. In this embodiment the ends of the toe protector side portions immediately adjacent to the outsole inner surface 12B are connected together by an integrally molded bottom connecting portion 22 that butts against the outsole inner surface, the corresponding part of the insole 20 resting on the inner surface of the bottom portion 22. Thus, impact or compression forces applied to the box toe protector top portion are, as with the prior art steel box toe protectors, transmitted through the protector body to the boot outsole 12 and thus to the ground. A box toe protector structure with such an integral bottom connecting portion 22 provides maximum resistance to spreading apart of the side portion ends under the downward acting forces to which it is subjected. However, the connecting portion makes it impossible to employ some methods of boot and shoe fabrication, such as goodyear welts, and in such cases it must be omitted; its omission does give the advantages that the resultant protector is lighter, less expensive, and of lower height in side profile. It is usual with such an unconnected structure for the side portion ends to terminate in a narrow inturned rim 23, the inner boundary of which is indicated in FIG. 2 by a broken line. The rim provides a surface of increased area butting against the outsole inner surface 12B and reducing the danger that under the impact or compression the edge would cut too deeply into the sole, and thus reduce to an unacceptable amount the safety clearance available for the wearer's toes.

The two parts of the metatarsal protector each also comprise a body of generally U-shaped transverse cross section having respective top portions forming a base of the respective U and two side portions forming respective sides of the U, each protector part also having a respective outer surface 16A or 18A convex toward the inner surface 10B of the boot upper and a respective inner surface 16B or 18B concave toward the inner surface 12B of the boot outsole. The ends of the side portions extend downwards at least sufficiently to engage the inner surface of the insole 20, and perhaps to engage the inner surface 12B of the outsole if the insole is sufficiently narrow at this location. It usually is not necessary, or even feasible, to connect the ends together by a connector 22, as with the toe protector.

In this embodiment the central part of the top portion of the toe protector part 14 and the central part of the top portion of the forward metatarsal protector part 16 are each provided above its respective outer surface with a respective curved force receiving part 24 and 26 having respective outer surfaces 24A and 26A and inner surfaces 24B and 26B. No corresponding force receiving part is provided for the rearward metatarsal protector part 18, as will be explained below. The combined protector as incorporated into a safety boot thus comprises a toe protector force receiving part 24 overlying the outer surface 14A of the toe protector top portion and a metatarsal protector force receiving part 26 overlying the outer surface 16A of the top portion of the forward metatarsal protector part. Each force receiving part overlies, and is of concave shape toward, the central part of its respective protector part. Each force receiving part is integrally molded with its respective protector part and each has two transversely spaced longitudinally extending side junctions 28 and 30 respectively therewith, the lower surfaces 24B and 26B being spaced from the respective central parts so as to leave an arcuate air space 32 between them. In this embodiment the two toe protector side junctions 28 are joined at their ends nearer to the toe end by an end junction 34 to form a continuous junction that is generally U-shaped in plan from above. The ends of the side portions of the two metatarsal parts are provided with respective inturned contact area increasing rims 35, as with the toe protector part.

The usual application point for the toe impact and compression tests is indicated in FIG. 1 by the arrow 36, while that for the metatarsal impact test is indicated by the arrow 38. The downward slope of the rearward metatarsal protector part 18 is sufficiently steep that heavy objects impacting thereon or crushing downward on the metatarsus are deflected downward onto the forward metatarsal protector part 16, and in particular onto the corresponding force receiving part 26. Moreover, it is possible to make the rearward part somewhat thicker while maintaining a satisfactory side profile, so that it is better able to withstand the applied forces without need to provide a force receiving part corresponding to that of the forward part. Any such downward acting compression and impact forces are applied to the upwardly convex force receiving parts and are operative to urge them toward the respective central part in the direction to increase their radius of curvature and to reduce the height of the arcuate air space 32, with the result that such downward compression and impact forces are converted, at least initially, to corresponding outwardly acting longitudinal forces distributed principally along the two side junctions 28 and 30 and to a lesser extent along the end junction 34. These longitudinal forces are in turn converted, at least to some extent, to compression forces applied to the sides of the body which act as columns to withstand them, so that the impact and compression forces applied to the centre portion of the relatively unsupported arch are directed to the portions of the body more able to withstand them. Moreover, the structure permits advantage to be taken of the somewhat higher modulus generally available in compression for plastics materials. It has been found that the provision of such centrally disposed, vertically spaced force receiving plates makes it possible to reduce substantially the overall thickness of the upper portions of the protectors required to enable them to meet the test requirements, so that the height of their side profiles can be kept within limits such that they can successfully be incorporated into a safety shoe or boot without making the shoe or boot appear unacceptably bulky, and with the possibility that existing boot-manufacturing molds, as used with the prior-used steel toe boxes, can also be used with the plastics material protectors of the invention.

The resistance of each protector part to the applied compression and impact forces is of course adjusted by adjustment of the thickness of different parts of the respective body, in particular by adjusting the thicknesses of the two body side portions and the body top portion. The resistance is also determined by the thickness of each force receiving part, and further by its effective radius of curvature, as compared to the radius of curvature of the body part top portion, which sets the height of the corresponding arcuate space, a smaller radius resulting in a higher arcuate air space 32 and a corresponding increase in resistance, since the force receiving part must collapse further before it can contact the protector body and move downward in contact with the body. Although in the embodiment described above only the forward part of the metatarsal protector is provided with a force receiving part and an accompanying arcuate space 32, in other embodiments both parts can be so provided, the two parts being flexibly connected so that they can flex with the remainder of the protector. Although a combined toe box and metatarsal protector has been illustrated, it will be apparent that the invention is equally applicable to separate toe box and metatarsal protectors. The toe box protector will usually not require longitudinal flexibility, and therefore will not be divided, while the metatarsal protector will usually require such flexibility, and can be made with more than two connected parts, especially in footwear of the larger sizes.

The compression and impact resistance of the protector also of course depends upon the choice of the plastics material used in its manufacture, and a practical commercial aspect that acts to limit the choice is that the overall cost of the resulting device must be competitive with an equivalent made of steel or other metal. There is a wide range of moldable materials that can be used, such as high density polyethylenes, high density polypropylenes, epoxies, polyurethanes, polycarbonates, ABS resins, polyesters, high impact nylons, and composites and alloys of such resins, all of which may be reinforced with glass or carbon fiber. Specific materials are polycarbonates sold under the trademarks "MAKROLON 9415" (Bayer-Mobay), "LEXAN 500-BL2176" (G.E. Plastics) and "NERLON"; polyurethanes sold under "ISOPLAST-202-lgf40" (Dow), "BAYFLEX 257/954/and 956" (all by Bayer); polycarbonate/polyurethane alloys sold under "TEXIN 4210 and 4215" (Bayer); polybutylene terephthalate polycarbonate sold under "XENOY 5720-BK1066" (G.E.Plastics); polyamide sold under "DURETHAN BC402" (Bayer); polyesters sold under "HYTREL" and "RYNITE"; high impact nylons sold by Bayer with designations "BC303", "BC402" and "9415Z", and those sold under the trade mark "ZYTEL" with designations "Nylon 66", "Supertough Nylon S1-66" and "Nylon 612. As with any commercial product, and particularly one that is so price sensitive as explained above, there are a number of factors that must be balanced in making the choice, including the cost of the chosen material and of its fabrication, and the width and height that can be tolerated in the final product.

Figure 3:
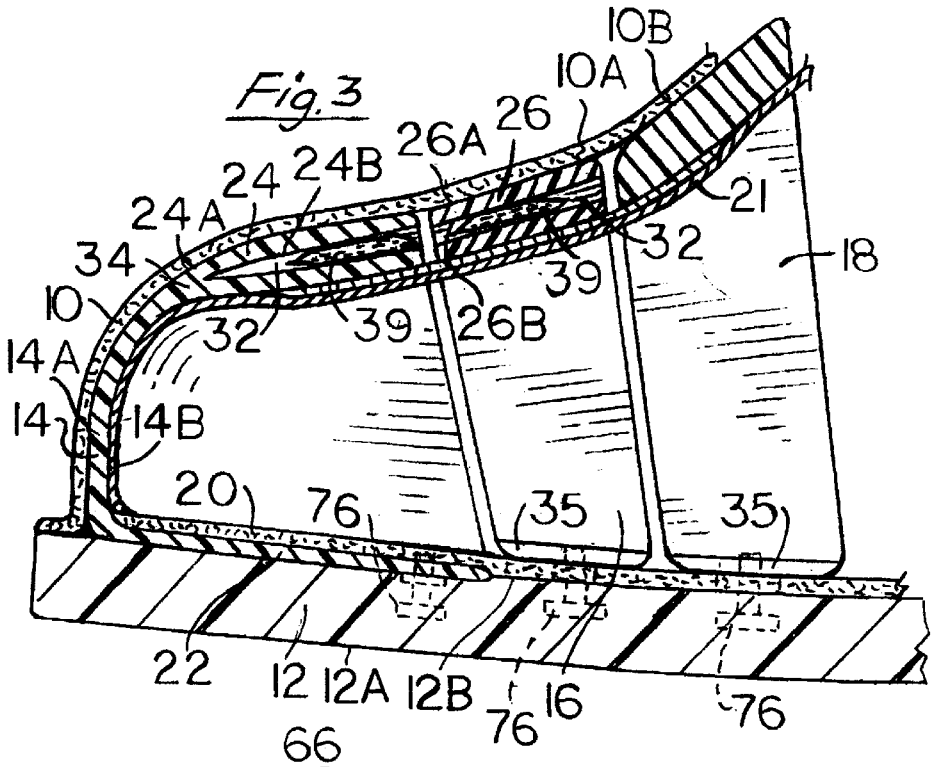
FIG. 3 is a cross-section on the line 3—3 of FIG. 2, showing the protector assembled into a safety boot, and illustrating some possible modifications to the toe protector structure.

A particular preferred embodiment as illustrated by FIG. 3 with an integrally molded force receiving member, but without an integrally molded connector 22 adjacent the insole, was incorporated into a men's safety boot, employing the glass fiber reinforced polycarbonate material sold by Bayer-Mobay under "MAKROLON-9415". The thickness of the side walls of the protectors 12 and 16 was 3.5 mm (0.140 in), that of the central parts of the protector bodies below the arcuate spaces 32 was 3.4 mm (0.135in), and that of the force receiving parts 24 and 26 was 2.5 mm (0.100 in). The arcuate spaces 32 had a width of 5.0 cm (2 ins) and a maximum height of 3.0 mm (0.120 in) to give a total height at this location of 8.9 mm (0.35 in) with the thicknesses of the portions between the side walls and the central parts increasing smoothly and progressively. Three samples were subjected to impact tests using the ANSI protocol for I75 with resultant residual clearances of 19/32 in; 19/32 in and 18/32 in, so that all of the samples easily met the minimum requirement of 16/32 in for a men's boot. By implication therefore the samples even more easily meet the test requirements for I30 and I50. Three more samples were subjected to compression tests, again using the ANSI protocol, but were only able to maintain the minimum clearance of 16/32 in with crushing forces of 1700 pounds, 1640 pounds and 1660 pounds. These samples therefore easily met the requirement for a C30 designation (1,000 pounds), but were just not able to obtain a C50 designation (1750 pounds). The intermediate designation of C50 was easily obtained with a corresponding embodiment incorporating an integrally molded connector 22, the sample maintaining the necessary clearance until the compressive force reached 2,000 pounds.

It will be appreciated by those concerned with the manufacture of molded safety footwear that it is important always to provide a toe box of constant exterior dimensions, so that it can be incorporated in existing designs of the boots without requiring expensive replacement of the moulds and redesign of the leather uppers. New toe box samples were therefore produced with the same external dimensions as those tested above, comprising a connecting portion 22 of 3 mm (0.120 in) thickness and side walls of the same thickness as before, namely 3.5 mm (0.140 in). The total thickness of the central portion including the arcuate space was virtually the same at 8.9 mm (0.356 in), when previously it was 8.75 mm (0.350 in), but the height of the arcuate space was reduced to 1.75 mm (0.070 in) to permit corresponding increases in the thicknesses of the two parts on either side of the space. As before two samples of the resultant boots easily qualified for an I75 rating, and in the compression test were able to withstand compressive forces of 954 Kg (2100 lbs) and 977 Kg (2150 lbs), so that they fully qualified for a C50 rating. Further tests are being conducted in which the side walls have been increased in thickness to 3.75 mm (0.150 in), which it is believed should enable the resultant footwear to meet the C75 requirement. It is known that this compression requirement could readily be met by increasing the thickness of the side walls to 4.5 mm (0.180 in) and the thickness of the connecting portion 22 to 4 mm (0.160 in) but, as described above, it is preferred to test progressively until the footwear consistently meet the test requirement with toe boxes of minimum thicknesses all round.

The dimensions of the body part and force receiving part for the metatarsal protector forward part 16 were the same as for the toe box protector, while the thickness of the top portion of the metatarsal protector rearward part was somewhat thicker, namely 4.375 mm (0.175 in), the rear arcuate edge of the rearward part being tapered so that the protector will merge smoothly with the shoe and boot layers between which it is incorporated.

It usually is possible to tell immediately by visual inspection when a steel-toed safety boot or shoe has been so heavily impacted as to deform the toe box, since the metal does not recover once stressed beyond its yield point. Many high impact plastics materials employable in the invention have much higher resilience than metals, and a boot or shoe in which the protector has been so highly stressed as to be no longer fully effective may appear from a visual inspection to still be sound. Such a possibility can be avoided with the boots and shoes of the invention by providing a crush and impact detector means within one or all of the arcuate spaces 32, the device being activated by a stress sufficient to reduce the arcuate space height by more than a predetermined amount. A suitable simple, inexpensive device is, for example, a small, sealed pouch or capsule 39 of plastics material containing a distinctively colored ink or dye. If the capsule is squeezed too hard it will rupture irreversibly under the internal pressure thus generated and discharge its contents on to the soft, and usually quite porous, lining 29, producing an instantly recognisable stain that will alert the user to the fact that the footwear has been subjected to such an excessive stress.

The integral molding of each protector part and its respective force receiving part, as with the embodiment of FIGS. 1–3, has the advantage that it can be produced by a single operation, but does impose the limitation that the same material must be used throughout if a simple, one-stage molding process is to be employed. In commercial practice a number of molds are required to produce the range of sizes of footwear that must be available, and the molds required for manufacture of any integral embodiment will generally be more complex, and therefore more expensive, than those required when the components are separate, owing to the need to employ a retractable tongue, or similar device, to form the arcuate spaces 32.

FIGS. 4 to 9 illustrate embodiments in which each protector body is formed separately from its respective force receiving part and this does have the advantage that different materials can be used for the two major components, making maximum use of the different mechanical properties usually available with different materials. They also provide the possibility of molding the toe protector body and one or both of the metatarsal protector bodies as a single component, which is then used in combination with a unitary force receiving part combining the two parts 24 and 26. In such an embodiment the integrally molded toe and forward metatarsal protector parts may be joined together by a relatively flexible narrow central connecting portion 40 that remains when two arcuate slots 42 are formed during the molding operation, or alternatively are formed by sawing through the molded part. The metatarsal protector part 16 is connected to the rearward part 18 in the same manner by a narrow central connecting portion 44 that remains from the formation of two arcuate slots 46 extending from the central portion, these slots also being formed either during the molding operation, or by sawing through the molded part. The relatively flexible connecting portions 40 and 44 permit longitudinal flexing of the protector to conform to the flexing of the boot under the action of walking.

In these embodiments the arcuate spaces 32 in the protectors are formed by respective depressions 48 and 50 (see FIG. 4) molded into the upper surfaces 14A and 16A of the respective protector part, each depression being shaped to provide two respective mutually facing, transversely spaced, longitudinally extending side surfaces 52 and 54 which respectively bound between themselves the central part of the respective top portion outer surface, these side surfaces extending outward from their central parts toward the inner surface 10B of the boot upper. The resultant combined protector is provided with a single upwardly convex curved force receiving plate member divided transversely into two connected parts 56 and 58 by arcuate slots 60 leaving a narrow central relatively flexible connection 62 between them, the plate member thus constituting the force receiving parts for both the toe and the forward metatarsal protector parts. Each plate member part has respective upper and lower surfaces and each has two transversely spaced longitudinally extending side edges 64 and 66, which in this embodiment are engaged respectively with the two side surfaces 52 and 54 of the respective protector body part. In this embodiment the side surfaces 52 of the toe protector body part and the side edges 64 of the corresponding plate member part 56 are joined at their ends nearer to the toe end by an end surface and an end edge respectively to form respective continuous surfaces and edges that are generally U-shaped in plan from above. Also in this embodiment, to facilitate assembly of the protector into the boot the force receiving force receiving part is retained by outwardly extending pins 68 on the toe protector body part engaging in respective apertures 69 in the force receiving plate, preferably of the same plastics material as the protector body and molded therewith, these pins serving also to connect the force receiving part to the forward metatarsal protector part, so that separate connecting means are not required. Such connecting pins can also be provided for the metatarsal protector part or parts, although such a structure is not illustrated. Alternatively the protector body and force receiving part can be held together for storage and assembly by adhesive, either applied as spots or lines at strategic locations or as a continuous line around the peripheries of the depressions 48 and 50 and the plate member.

Any such compression and impact forces applied to the force receiving part are operative to urge the respective force receiving part toward the respective central part in the direction to flatten the force receiving part and to reduce the height of the arcuate space 32, thereby forcibly butting its side edges 46 against the two cooperating side surfaces 52 and 54 with conversion of such compression and impact forces to corresponding butting forces distributed principally along the side surfaces and to a lesser extent along the curved end surface. As with the embodiment of FIGS. 1–3, these butting forces are in turn converted at least to some extent to compression forces applied to the sides of the body which act as columns to withstand them, so that the impact and compression forces applied to the centre portion of the relatively unsupported arch are directed to the portions of the body more able to withstand them. Although in the embodiments illustrated the force receiving part edges 46 and 52 are butted against the corresponding side and end surfaces 36, 38 and 50, in other embodiments a small clearance may be provided between the edges and surfaces so that some flattening of the force receiving part takes place before the edges and surfaces engage. The force receiving part can be of molded plastics material or of sheet steel, since such a simple component can be produced relatively inexpensively by stamping.

In an embodiment as illustrated by FIGS. 4–7, molded from glass fiber filled polyester, the overall thickness of the side and top portions of the body of the toe box protector 14 was 3.125 mm (0.125 in), increasing to 4.7 mm (0.1875 in) in the neighbourhood of the side and end surfaces 52, so that this overall thickness is maintained at the location of the depression 48 that forms the arcuate space, while the thickness of the bottom portion was 1.56 mm (0.0625 in). The vertical height of the side surfaces 52 was also 1.56 mm (0.0625 in), while the thickness of the force receiving part 56, which was of uniform thickness, was the same so that its edges that butt the surfaces 52 were also of the same dimension. The force receiving part was of a polycarbonate resin and its curvature relative to that of the toe protector body top portion was such that at its centre the arcuate air space 32 was 1.25 mm (0.050 in) in height. The toe box of such an embodiment was able to achieve similar ratings as with the previously described embodiments with regard to impact and compression . Increase of the height of the arcuate space will increase the resistance of the protector to the applied forces but with an increase in the profile height of the protector; the specific value will therefore depend upon the size of the shoe or boot, the material from which the protector has been made, and the level of the certification that is required.

Figure 7:
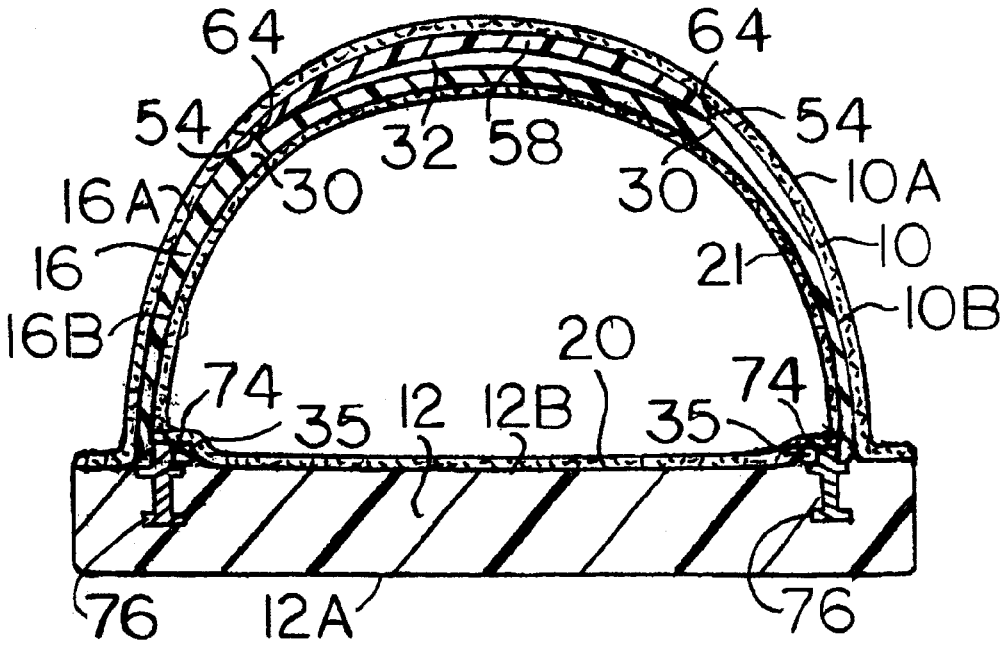
FIG. 7 is a transverse cross-section through the metatarsal protector part of FIG. 4 taken on the line 7—7 of FIG. 4.
Figure 8:
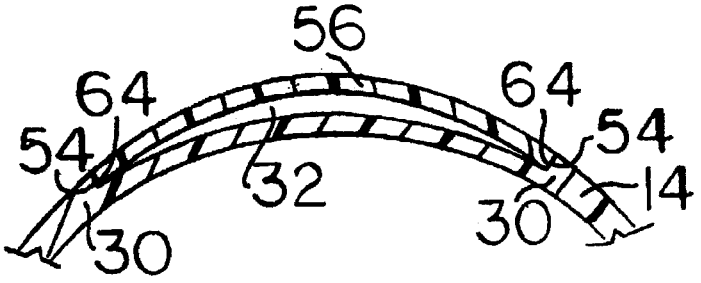
FIGS. 8 and 9 are part cross-sections showing different ways in which a separate force receiving part of the embodiment of FIG. 4 can engage with its protector body part.

FIGS. 3 and 7 illustrate structures employing reinforcing pins which may be employed with both the toe and metatarsal protectors to increase their resistance to spreading apart of the side portions under the applied forces in the absence of a connecting portion 22. Such resistance is necessary to ensure that these forces are maintained as much as possible as compression forces. FIG. 3 is a side elevation and shows the longitudinal disposition of such pins for this purpose, while FIG. 7 is a transverse cross section through a metatarsal protector and shows the transverse location of such pins. Thus, FIG. 7 shows the metatarsal protector side rims 35 provided as close as possible to the side portions inner surfaces with apertures 74 into which are inserted downward extending double headed pins 76, which subsequently are molded securely into the sole during its formation by the molding operation. The toe protector of FIG. 3 has a connecting portion 22, but in its absence the rims 23 which are provided instead may be similarly provided with such apertures 74 and pins 76.

Another way of providing some additional resistance to such spreading forces is illustrated in FIG. 2, comprising several complete wraps of a flexible tape 78 tightly encircling the toe protector body, as shown in broken lines. The tape is of the type that is particularly resistant to longitudinal stretching under tension, such as one with glass or carbon fibres extending longitudinally and attached to or embedded in a suitable matrix material. A number of such tapes are available commercially and a typical tape employing glass fibres is of width 12.5 mm (0.5 in) and thickness 0.125 mm (0.005 in).

Figure 4:
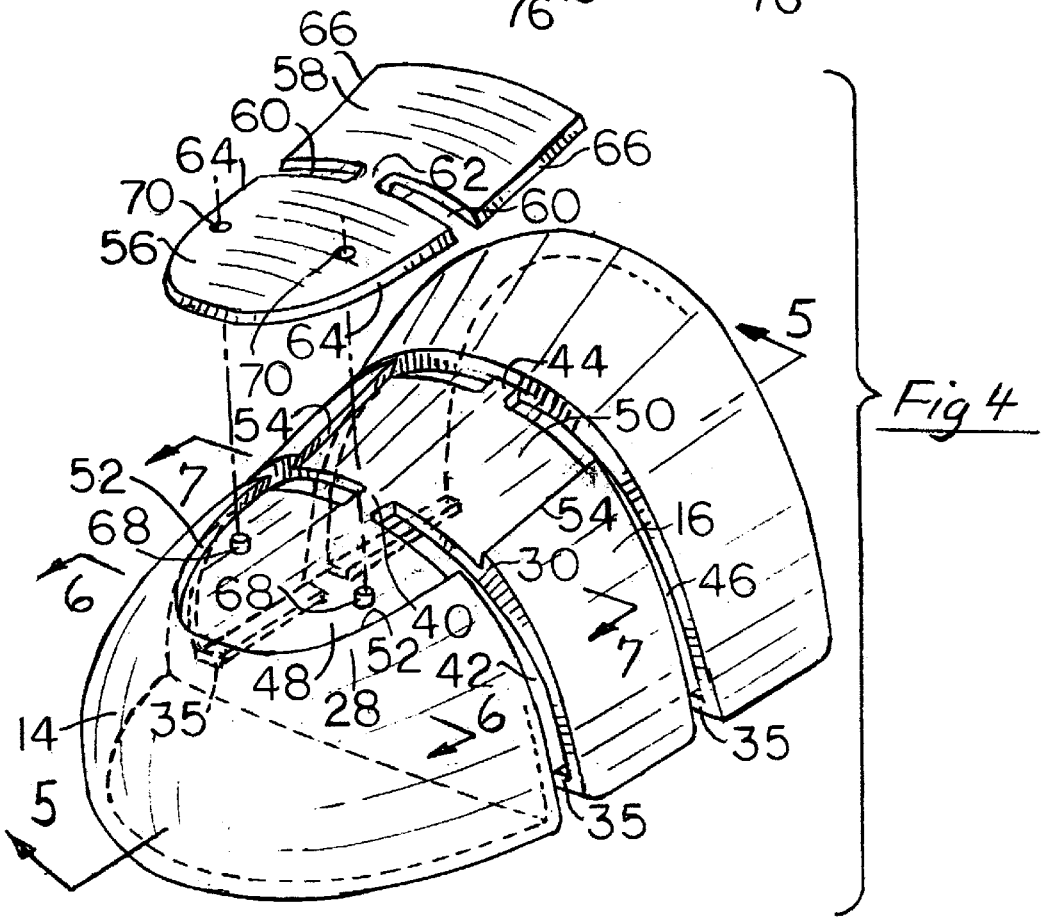
FIG. 4 is an exploded perspective view of a second embodiment from the front and slightly to one side, in which force receiving parts for the toe and a forward part of the metatarsal protectors are separate from the protector bodies.

As will be seen from FIGS. 4 and 5, the surfaces 52 and 54 are inclined inward toward one another as they protrude from the central part of the upper surface of the top portion of the respective protector body part, so that the resultant corners are less than a right angle, and the edges of the force receiving parts are correspondingly chamfered to the same angle, so that as the downward acting forces increase the edges of the force receiving parts are wedged even more firmly into the corners. Instead, to facilitate the molding operation and to simplify the production of the force receiving plate, the surfaces may protrude perpendicularly from the central parts of the respective upper surface of the top portions of the protector body parts, as shown for example in FIG. 8, and chamfering of the plate part edges is not required.

In the embodiments described the edges of the force receiving parts engage two transversely spaced longitudinally extending surfaces and a connecting end surface of the toe protector part body, and two transversely spaced longitudinally extending surfaces of the metatarsal protector part body. In other embodiments not specifically illustrated the force receiving part edges may, particularly with one which is solely a toe protector, instead engage two longitudinally spaced transversely extending surfaces of the body, or the force receiving part may have both its longitudinally extending edges and its transversely extending edges engageable with cooperating surfaces of the protector body, the force receiving part having a generally domed shape; in such embodiments it will be usually be necessary to provide separate force receiving parts for the toe protector and the part or parts of the metatarsal protector.

Figure 9:
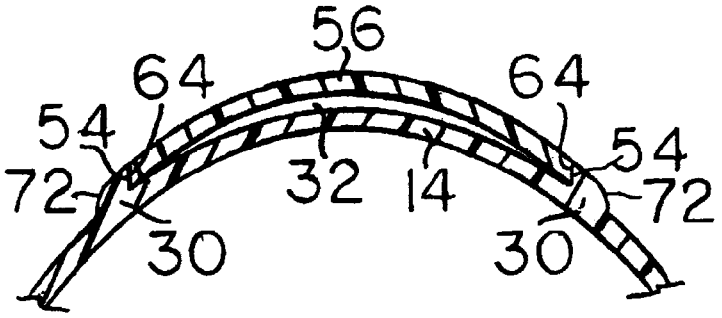

In the embodiments so far described the surfaces 52 and 54 are provided by forming corresponding depressions in the central portions of the protector bodies, but instead a structure such as is illustrated by FIG. 9 can be used in which the side surfaces are provided by outward extending ridges 72 molded into the upper surfaces of the protector body parts.

I claim:

1. A toe box protector for safety footwear that comprise an upper and a sole joined to one another, the upper and sole each having respective outer and inner surfaces and having respective registering toe regions; wherein the toe box protector comprises a body molded from plastics material to have a generally U-shaped transverse cross section, the body having a top portion constituting a base of the U and two side portions constituting respective sides of the U;

wherein the toe box protector when incorporated into safety footwear is interposed between the upper and sole toe regions, and when so interposed has an outer surface convex toward the inner surface of the upper and an inner surface concave toward the inner surface of the sole;

wherein the toe box protector also comprises a force receiving part having respective upper and lower surfaces and overlying the central part of the top portion outer surface with its lower surface spaced from the central part, the force receiving part joining at two transversely spaced junctions with the remainder of the body, and being of concave shape toward the central part so as to provide an arcuate space of predetermined height between the force receiving part lower surface and the top portion central part outer surface;

whereby compression and impact forces applied to the force receiving part urge the force receiving part toward the central part of the top portion with corresponding reduction in the height of the arcuate space and conversion of such compression and impact forces to corresponding longitudinal forces distributed along the transversely spaced junctions;

wherein the thicknesses of the two body side portions, of the body top portion, and of the force receiving part, together with the height of the arcuate space, are such that the protector maintains a minimum internal clearance in the foot receiving cavity of 12.7 mm (16/32 in) for men's footwear and 11.9 mm (15/32 in) for women's footwear when subjected to a compression force of at least 455 Kg (1,000 lbs; 4,448 Newtons) or to an impact force of at least 40.7 joules (30 foot pounds);

wherein the toe box protector further comprises a crush or impact indicating means in the arcuate space that is irreversibly ruptured upon the reduction in height of the arcuate space resulting from the application of a compression force of more than 455 Kg (1,000 lbs; 4,448 Newtons) or the application of an impact force of more than 40.7 joules (30 foot pounds); and wherein the crush or impact indicating means comprise a capsule of ink or dye that is irreversibly ruptured by a crush or impact force of the specified value to discharge its contents into the footwear.

2. A toe protector as claimed in claim 1, wherein the thicknesses of the two body side portions, of the body top portion, and of the force receiving part, together with the height of the arcuate space, are such that the protector maintains a minimum internal clearance in the foot receiving cavity of 12.7 mm (16/32 in) for men's footwear and 11.9 mm (15/32 in) for women's footwear when subjected to a compression force of at least 795 Kg (1,750 lbs; 7,784 Newtons) or to an impact force of at least 67.8 joules (50 foot pounds); and wherein the crush or impact indicating means is irreversibly ruptured upon the reduction in height of the arcuate space resulting from the application of a compression force of more than 795 Kg (1,750 lbs; 7,784 Newtons) or an impact force of more than 67.8 joules (50 foot pounds).

3. A toe protector as claimed in claim 1, wherein the thicknesses of the two body side portions, of the body top portion, and of the force receiving part, together with the height of the arcuate space, are such that the protector maintains a minimum internal clearance in the foot receiving cavity of 12.7 mm (16/32 in) for men's footwear and 11.9 mm (15/32 in) for women's footwear when subjected to a compression force of at least 1,134 Kg (2,500 lbs; 11,121 Newtons) or to an impact force of at least 101.7 joules (75 foot pounds); and wherein the crush or impact indicating means is irreversibly ruptured upon the reduction in height of the arcuate space resulting from the application of a compression force of more than 1,134 Kg (2,500 lbs; 11,121 Newtons) or an impact force of more than 101.7 joules (75 foot pounds).

4. A toe protector as claimed in claim 1, wherein the protector body and the force receiving part are molded integrally with one another to provide respective integral junctions between the force receiving part and the protector body.

5. A toe protector as claimed in claim 1, wherein the junctions of the protector body and the force receiving part are joined at their ends nearer to the toe end respectively by an end junction to form a continuous junction that is generally U-shaped in plan.

6. A toe protector as claimed in claim 1, wherein the two side portions of the toe protector body have their respective lowermost ends adjacent to the sole and the two ends are connected by an integrally molded bottom portion that butts against the sole.

7. A toe protector as claimed in claim 1, wherein the toe protector body is provided at its top portion outer surface with two mutually facing, spaced surfaces extending outward from the outer surface toward the inner surface of the upper, the surfaces bounding between them the central part of the top portion outer surface;

wherein the toe protector also comprises a separate force receiving part having respective upper and lower surfaces and overlying the central part with its lower surface spaced from the said central part, the force receiving part being of concave shape toward the said central part and having two spaced edges engageable respectively at said transversely spaced junctions with the two surfaces of the protector body to join the force receiving part with the protector body at the junctions;

whereby compression and impact forces applied to the force receiving force receiving part are operative to urge the force receiving part toward the said central part and to forcibly butt its edges against the two cooperating surfaces with conversion of such compression and impact forces to corresponding butting forces distributed along the surfaces.

8. A toe protector as claimed in claim 7, wherein the two spaced surfaces of the protector body are transversely spaced longitudinally extending side surfaces and the two spaced edges of the force receiving force receiving part are corresponding transversely spaced longitudinally extending side edges.

9. A metatarsal protector for safety footwear that comprise an upper and a sole joined to one another, the upper and sole each having respective outer and inner surfaces and having respective registering metatarsal regions;

wherein the metatarsal protector comprises a body molded from plastics material to have a generally U-shaped transverse cross section, the body having a top portion constituting a base of the U and two side portions constituting sides of the U, the protector thereby defining a foot receiving cavity whose height constitutes its internal clearance;

wherein the metatarsal protector when incorporated into safety footwear is interposed between the metatarsal regions, and when so interposed has an outer surface convex toward the inner surface of the upper and an inner surface concave toward the inner surface of the sole;

wherein the metatarsal protector also comprises a force receiving part having respective upper and lower surfaces and overlying the central part of the top portion outer surface with its lower surface spaced from the central part, the force receiving part joining at two transversely spaced junctions with the remainder of the body and being of concave shape toward the central part so as to provide an arcuate space of predetermined height between the force receiving part lower surface and the top portion central part outer surface;

whereby compression and impact forces applied to the force receiving part urge the force receiving part toward the central part of the top portion with corresponding reduction in the height of the arcuate space and conversion of such compression and impact forces to corresponding longitudinal forces distributed along the transversely spaced junctions;

wherein the thicknesses of the two body side portions, of the top portion, and of the force receiving part, together with the height of the arcuate space, are such that the protector maintains a minimum internal clearance of 25.4 mm (32/32 in) for men's footwear and 24 mm (30/32 in) for women's footwear when subjected to an impact force of at least 40.7 joules (30 foot pounds);

wherein the protector comprises an impact indicating means interposed in the arcuate space between the force receiving part and the remainder of the protector body, the impact indicating means being irreversibly ruptured upon the reduction in height of the arcuate space resulting from the application of an impact force of more than 40.7 joules (30 foot pounds); and wherein the impact indicating means comprise a capsule of ink or dye that is irreversibly ruptured by the impact force of the specified value to discharge its contents into the footwear.

10. A metatarsal protector as claimed in claim 9, wherein the thicknesses of the two body side portions, of the top portion, and of the force receiving part, together with the height of the arcuate space, are such that the protector maintains a minimum internal clearance of 25.4 mm (32/32 in) for men's footwear and 24 mm (30/32 in) for women's footwear when subjected to an impact force of at least 67.8 joules (50 foot pounds).

11. A metatarsal protector as claimed in claim 9, wherein the thicknesses of the two body side portions, of the top portion, and of the force receiving part, together with the height of the arcuate space, are such that the protector maintains a minimum internal clearance of 25.4 mm (32/32 in) for men's footwear and 24 mm (30/32 in) for women's footwear when subjected to an impact force of at least 101.7 joules (75 foot pounds).

12. A metatarsal protector as claimed in claim 9, wherein the protector body and the force receiving part are molded integrally with one another to provide respective integral junctions between the force receiving part and the protector body.

13. A metatarsal protector as claimed in claim 9, wherein the metatarsal protector body is provided at its top portion outer surface with two mutually facing, spaced surfaces extending outward from the outer surface toward the inner surface of the upper, the surfaces bounding between them the central part of the top portion outer surface;

wherein the metatarsal protector also comprises a separate force receiving part having respective upper and lower surfaces and overlying the central part with its lower surface spaced from the said central part, the force receiving part being of concave shape toward the said central part and having two spaced edges engageable respectively at said transversely spaced junctions with the two surfaces of the protector body to join the force receiving part with the protector body at the junctions;

whereby impact forces applied to the force receiving force receiving part are operative to urge the force receiving part toward the said central part and to forcibly butt its edges against the two cooperating surfaces with conversion of such impact forces to corresponding butting forces distributed along the surfaces.

14. A metatarsal protector as claimed in claim 13, wherein the two spaced surfaces of the protector body are transversely spaced longitudinally extending side surfaces and the two spaced edges of the force receiving force receiving part are corresponding transversely spaced longitudinally extending side edges.

15. A combined toe box and metatarsal protector for safety footwear that comprise an upper and a sole joined to one another, the upper and sole each having respective outer and inner surfaces and having respective registering toe and metatarsal regions;

wherein the combined protector comprises a toe box protector part and a metatarsal protector part molded from plastics material attached to one another, each of said parts comprising a body of generally U-shaped transverse cross section having a top portion constituting a base of the U and two side portions constituting sides of the U, the toe box protector part thereby providing a toe receiving cavity therein whose height constitutes its internal clearance, and the metatarsal protector part thereby providing a foot receiving cavity therein whose height constitutes its internal clearance;

the toe and metatarsal protector when incorporated into safety footwear being interposed between the toe and metatarsal regions, and when so interposed each having an outer surface convex toward the inner surface of the upper and an inner surface concave toward the inner surface of the sole; and wherein the toe and metatarsal protector also comprises for each of its parts a respective force receiving part having respective upper and lower surfaces and overlying the respective central part of the respective top portion outer surface with its respective lower surface spaced from the respective central part, each force receiving part joining at two respective transversely spaced junctions with the remainder of the respective body and being of concave shape toward the respective central part so as to provide a respective arcuate space of predetermined height between each force receiving part lower surface and its associated top portion central part outer surface;

whereby compression and impact forces applied to each force receiving part urge the force receiving part toward the respective central part with corresponding reduction in the height of the respective arcuate space and conversion of such compression and impact forces to corresponding longitudinal forces distributed along the junctions; and wherein the thicknesses of each of the two body side portions, of each body top portion, and of each respective force receiving part, together with the height of the respective arcuate space, are such that the toe box protector maintains a minimum internal clearance in the foot receiving cavity of 12.7 mm (16/32 in) for men's footwear and 11.9 mm (15/32 in) for women's footwear when subjected to a compression force of at least 455 Kg (1,000 lbs; 4,448 Newtons), or to an impact force of at least 40.7 joules (30 foot pounds), and are such that the metatarsal protector maintains a minimum internal clearance of 25.4 mm (32/13 in) for men's footwear and 24 mm (30/32 in) for women's footwear when subjected to an impact force of at least 40.7 joules (30 foot pounds).

16. A toe box and metatarsal protector as claimed in claim 15, wherein the thicknesses of each of the two body side portions, of each body top portion, and of each respective force receiving part, together with the height of the respective arcuate space, are such that the toe box protector maintains a minimum internal clearance in the foot receiving cavity of 12.7 mm (16/32 in) for men's footwear and 11.9 mm (15/32 in) for women's footwear when subjected to a compression force of at least 795 Kg (1,750 lbs; 7,784 Newtons), or to an impact force of at least 68.8 joules (50 foot pounds), and are such that the metatarsal protector maintains a minimum internal clearance of 25.4 mm (32/32 in) for men's footwear and 24 mm (30/32 in) for women's footwear when subjected to an impact force of at least 67.8 joules (50 foot pounds).

17. A toe box and metatarsal protector as claimed in claim 15, wherein the thicknesses of each of the two body side portions, of each body top portion, and of each respective force receiving part, together with the height of the respective arcuate space, are such that the toe box protector maintains a minimum internal clearance in the foot receiving cavity of 12.7 mm (16/32 in) for men's footwear and 11.9 mm (15/32 in) for women's footwear when subjected to a compression force of at least 1,134 Kg (2,500 lbs; 11,121 Newtons), or to an impact force of at least 101.7 joules (75 foot pounds), and are such that the metatarsal protector maintains a minimum internal clearance of 25.4 mm (32/32 in) for men's footwear and 24 mm (30/32 in) for women's footwear when subjected to an impact force of at least 101.7 joules (75 foot pounds).

18. A toe box and metatarsal protector as claimed in claim 15, wherein each protector body part and the corresponding force receiving part are molded integrally with one another to provide respective integral junctions between the force receiving parts and the protector body parts.

19. A toe box and metatarsal protector as claimed in claim 15, wherein the side junctions of the toe protector body part are joined at their ends nearer to the toe end by an end junction to form a continuous junction that is generally U-shaped in plan.

20. A toe box and metatarsal protector as claimed in claim 15, wherein the two side portions of the toe box protector part have their respective lowermost ends adjacent to the sole and the two ends are connected by an integrally molded bottom portion that butts against the sole.

21. A toe box and metatarsal protector as claimed in claim 15, wherein the toe box protector body part and the metatarsal protector body part are connected together for storage and/or installation by a longitudinally extending thin piece of flexible material.

22. A toe box and metatarsal protector as claimed in claim 15, and comprising a crush or impact indicating means interposed in the arcuate space of the toe box protector between the force receiving part and the remainder of the protector body, the crush or impact indicating means being irreversibly ruptured upon the reduction in height of the arcuate space resulting from the application of a compression force of more than 455 Kg (1,000 lbs; 4,448 Newtons) or an impact force of more than 40.7 joules (30 foot pounds).

23. A toe box and metatarsal protector as claimed in claim 22, wherein the crush or impact indicating means comprise a capsule of ink or dye that is irreversibly ruptured by a crush or impact force of the specified value to discharge its contents into the footwear.

24. A toe box and metatarsal protector as claimed in claim 15, wherein each protector body is provided at its top portion outer surface with two mutually facing, spaced surfaces extending outward from the outer surface toward the inner surface of the upper, the surfaces bounding between them the central part of the respective body;

wherein each protector also comprises a separate force receiving part having respective upper and lower surfaces and overlying the respective central part with its lower surface spaced from the said central part, the force receiving part being of concave shape toward the said central part and having two spaced edges engageable respectively at said transversely spaced junctions with the two surfaces of the protector body to join the force receiving part with the protector body at the junctions;

whereby compression and impact forces applied to the force receiving part are operative to urge force receiving part toward the said central part and to forcibly butt its edges against the two cooperating surfaces with conversion of such compression and impact forces to corresponding butting forces distributed along the surfaces.

25. A toe and metatarsal protector as claimed in claim 24, wherein the two spaced surfaces of each protector body are transversely spaced longitudinally extending side surfaces and the two spaced edges of the respective force receiving part are corresponding transversely spaced longitudinally extending side edges.

* * * * *